US006550141B1

(12) United States Patent
Rivers et al.

(10) Patent No.: US 6,550,141 B1
(45) Date of Patent: Apr. 22, 2003

(54) RAZOR HEADS WITH INTERMEDIATE GUARD ELEMENTS

(75) Inventors: David F. Rivers, Wallingford, CT (US); Andrew Pennella, Stamford, CT (US); Paul D. Richard, Shelton, CT (US)

(73) Assignee: Warner-Lambert Company, Morris Plains, NJ (US)

( * ) Notice: Subject to any disclaimer, the term of this patent is extended or adjusted under 35 U.S.C. 154(b) by 0 days.

(21) Appl. No.: 09/626,194

(22) Filed: Jul. 28, 2000

(51) Int. Cl.[7] ..... B26B 21/06
(52) U.S. Cl. ..... 30/50; 30/77; 30/346.57
(58) Field of Search ..... 30/41, 41.5, 50, 30/34.2, 81, 82, 77, 346.59; D28/47

(56) References Cited

U.S. PATENT DOCUMENTS

| | | | | |
|---|---|---|---|---|
| 4,272,885 A | | 6/1981 | Ferraro | |
| 5,313,705 A | | 5/1994 | Rivers et al. | 30/50 |
| 5,318,429 A | | 6/1994 | Butlin et al. | 425/116 |
| 5,359,774 A | | 11/1994 | Althaus | |
| 5,447,084 A | | 9/1995 | Althaus | 76/104.1 |
| 5,794,343 A | | 8/1998 | Lee et al. | 30/50 |
| 5,903,979 A | * | 5/1999 | Oldroyd | 30/41 |
| 6,131,287 A | * | 10/2000 | Prochaska et al. | 30/41 |

FOREIGN PATENT DOCUMENTS

| | | | |
|---|---|---|---|
| EP | 0 314 266 A1 | 5/1989 | B26B/21/40 |
| GB | 2 178 687 A | 2/1987 | B26B/21/54 |
| JP | 9135972 | 5/1997 | |
| JP | 9135973 | 5/1997 | |
| WO | WO9604111 | 2/1996 | |

* cited by examiner

*Primary Examiner*—Douglas D. Watts
(74) *Attorney, Agent, or Firm*—Peter C. Richardson; Gregg C. Benson; Raymond D. Thompson

(57) ABSTRACT

Razor heads comprising at least one blade and a plurality of guard elements over the leading edge at a plurality of intermediate portions. According to preferred embodiments, the guard elements are integrally molded with at least one or more of a blade support, spacer element(s), forward guard member and cap member. The use of integrally molded guard elements facilitate efficient, quicker and less expensive manufacturing, provide greater design flexibility, and provide greater blade stability. Additionally, in preferred embodiments, when the molded guard elements are aligned with spacers, these guard elements do not interfere with the rinsability of the razor head. The intermediate guard elements also provide additional sites for the placement of shaving aids and other skin flow control materials such as materials having a relatively high coefficient of friction.

46 Claims, 13 Drawing Sheets

RAZOR HEADS WITH INTERMEDIATE GUARD ELEMENTS

The present invention is directed to razor heads such as shaving cartridges and, more particularly, to razor heads comprising intermediate guard elements.

BACKGROUND OF THE INVENTION

Many razor heads found on the market have a guard member disposed forwardly of the cutting edges of two blades and a cap member. Each of these four elements contact the skin surface during shaving and, therefore, are often referred to as "skin-engaging" elements. In a typical safety razor, these four skin-engaging elements are disposed in a spaced relation such that a small space is provided between the guard member and the first blade edge, another space is provided between the two blade edges, and another space may be provided between the second blade edge and the skin-engaging portion of the cap member. Such spaces are typically provided between the skin-engaging portions of these four elements, though not necessarily between other portions of these elements which do not contact the skin. For example, the forward or "seat" blade may be attached directly to the guard member at a point remote from the cutting edge of the seat blade but a space would typically be provided between the skin-engaging surface of the guard member and the sharpened edge of the seat blade.

Though it has been formerly recognized that the relative positioning and spacing of the skin-engaging portions of these skin-engaging elements affects the flow of skin across the cutting edges of the blades as well as the shaving angle at which the skin contacts the blade edges, it is desirable to provide still greater skin flow control.

A relatively recent improvement to the field of wet shaving relating to the control of skin as it flows between blades is the use of wire wrapped blades. Wire wrapped blades comprise at least one metal wire wrapped, in spaced intervals, around the sharpened leading edge of a plurality of blades to limit the amount of skin that can flow between the blades.

The use of wires to wrap blades provides an advantage during shaving, however, manufacturing is inherently complicated by the need to position the wires relative to the blade edges. Additionally, previously known wire wrapped blades have utilized a single size wire with a constant diameter which places limitations upon the shape and contour of the guard elements spaced along the cutting edge of the blades. Additionally, it can be difficult to secure wire guard elements across the cutting edge of a blade in a razor head. These wires also do not significantly inhibit movement of the blade edges in a direction perpendicular to a shaving stroke during shaving.

Therefore, it would be desirable to provide razor heads with improved skin flow controls which are easier to manufacture, relatively inexpensive to manufacture, which provide greater design flexibility for controlling skin as it flows over the cutting edges of one or, more blades during shaving, and which permit greater flexibility of the entire razor head during shaving.

SUMMARY OF THE INVENTION

The various aspects of the present invention are directed to novel skin-engaging elements for razor heads including their design, construction and manufacture. The various aspects of the present invention are designed to provide a razor head which enables a safe, close and comfortable shave while facilitating an easier, more reproducible and less expensive manufacturing process and which provides greater design flexibility with respect to the size and positioning of guard elements, shaving aids and high coefficient of friction materials relative to the blades. Additionally, disclosed embodiments are also designed to facilitate the easy removal of shaving debris which may accumulate in spaces of razor heads of the present invention.

One embodiment of the present invention is a razor head comprising at least one blade having a first end, a second end, discrete portions intermediate the ends, and a leading edge. A plurality of guard elements are molded over and engage and cover the leading edge of the blade at a plurality of locations intermediate the ends of the blade and separate the discrete portions of the blade from each other. According to preferred embodiments of the present invention, the molded guard elements are integrally molded with one or more of a blade support, spacer element(s), forward guard member(s) or cap member(s). It is believed that the use of integrally molded guard elements, especially when the guard elements are integrally molded with blade supports or spacers, provide greater blade stability and allow less relative movement of the blade edges than wire wrapped blades since the molded guard elements tend to hold the blades in position more rigidly when the blades encounter hair during a shaving stroke. Those skilled in the art will appreciate that it is desirable to maintain predetermined blade spacing during shaving. Relative movements of the blade edges during shaving which significantly change the edge to edge spacing can result in a less than optimum shave. The various embodiments of the present invention also provide greater design flexibility in the size and shape of the intermediate guard elements. For example, the intermediate guard elements can readily extend outwardly from the blade edge any desired distance and a single razor head can readily be provided with guard elements which extend different distances from the edge of one blade or the edges of different blades.

Additionally, in preferred embodiments, when the molded guard elements are aligned with spacers, these guard elements do not inhibit the rinsability of the razor head.

The various embodiments of the present invention also advantageously provide additional sites for the placement of shaving aids and other skin flow control materials such as materials having high or low coefficients of friction.

Other aspects of the present invention comprise methods of manufacturing razor heads. One preferred method comprises insert molding a razor head with a blade support, forward guard member, cap member, spacers and novel guard elements integrally molded in a single or sequential molding process.

Other methods of the present invention comprise sequentially molding shaving aids and resilient skin engaging materials having high or low coefficients of friction onto the various skin engaging elements of the disclosed razor heads.

DETAILED DESCRIPTION

The various embodiments of the present invention relate to new razor heads comprising molded, preferably thermoplastic, guard elements positioned over intermediate portions of at least one leading edge of a blade in order to provide enhanced skin flow control and blade stability during shaving. The various aspects of the present invention also comprise novel methods of manufacturing razor heads as described in greater detail below. As used herein, the term "razor head" is meant to include cartridges adapted to be connected to a separate razor handle as well as the operative cutting portion of a disposable razor wherein the handle and cutting portion are formed as single unit.

Figure 1:
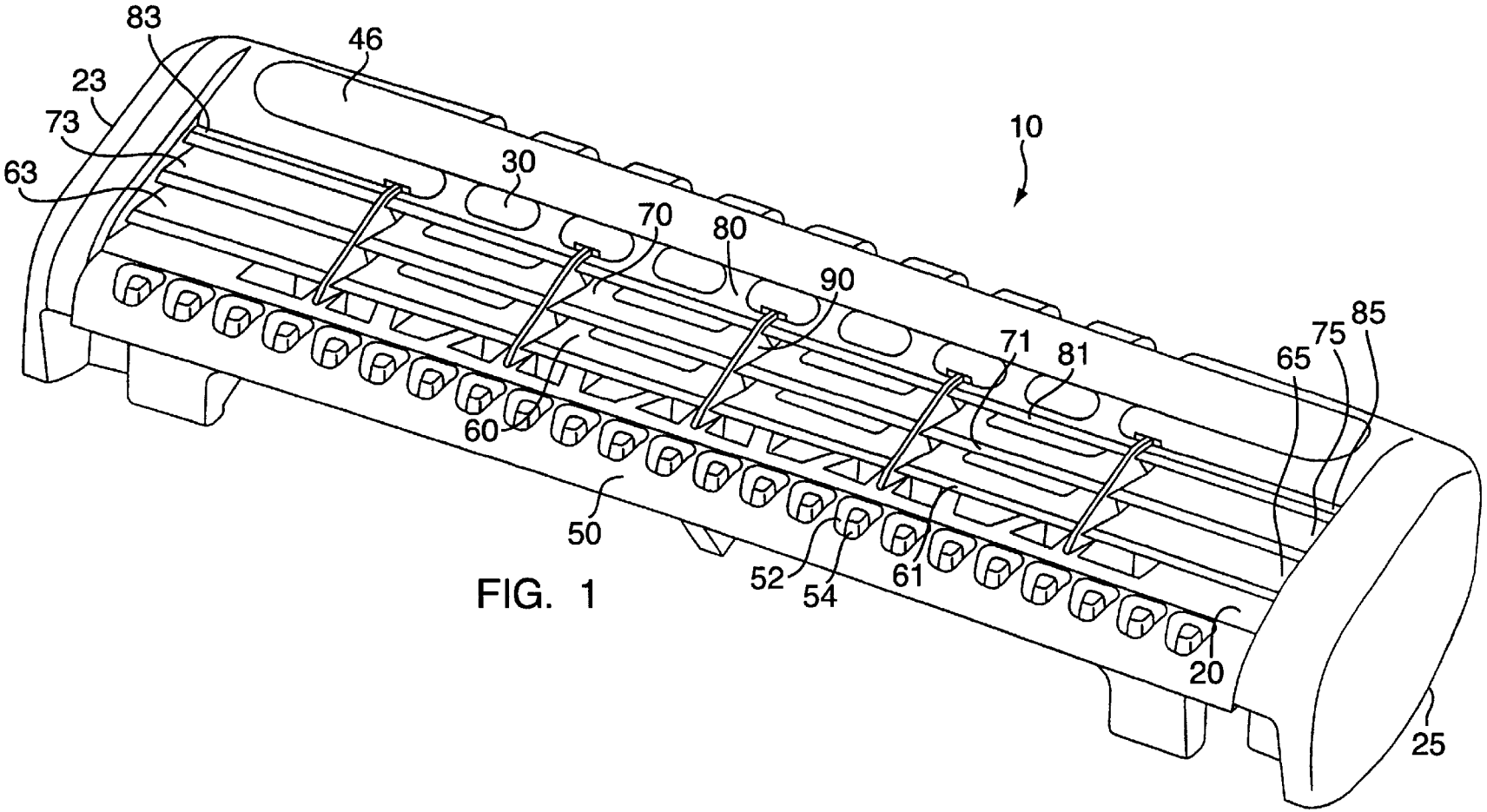
FIG. 1 is a perspective view of one embodiment of the present invention.
Figure 2:
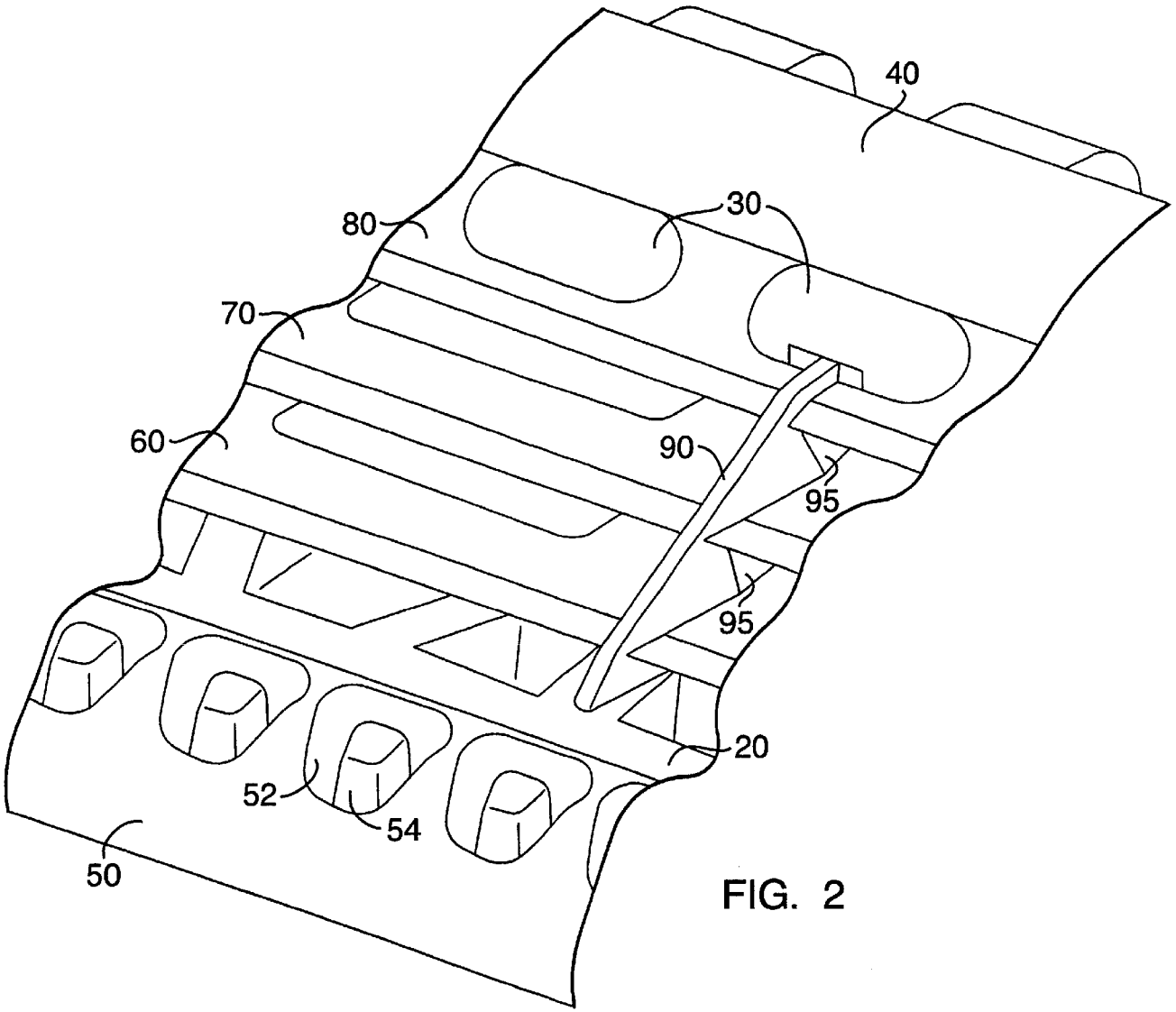
FIG. 2 is an enlarged, partial perspective view of a portion of the razor head shown in FIG. 1.
Figure 3:
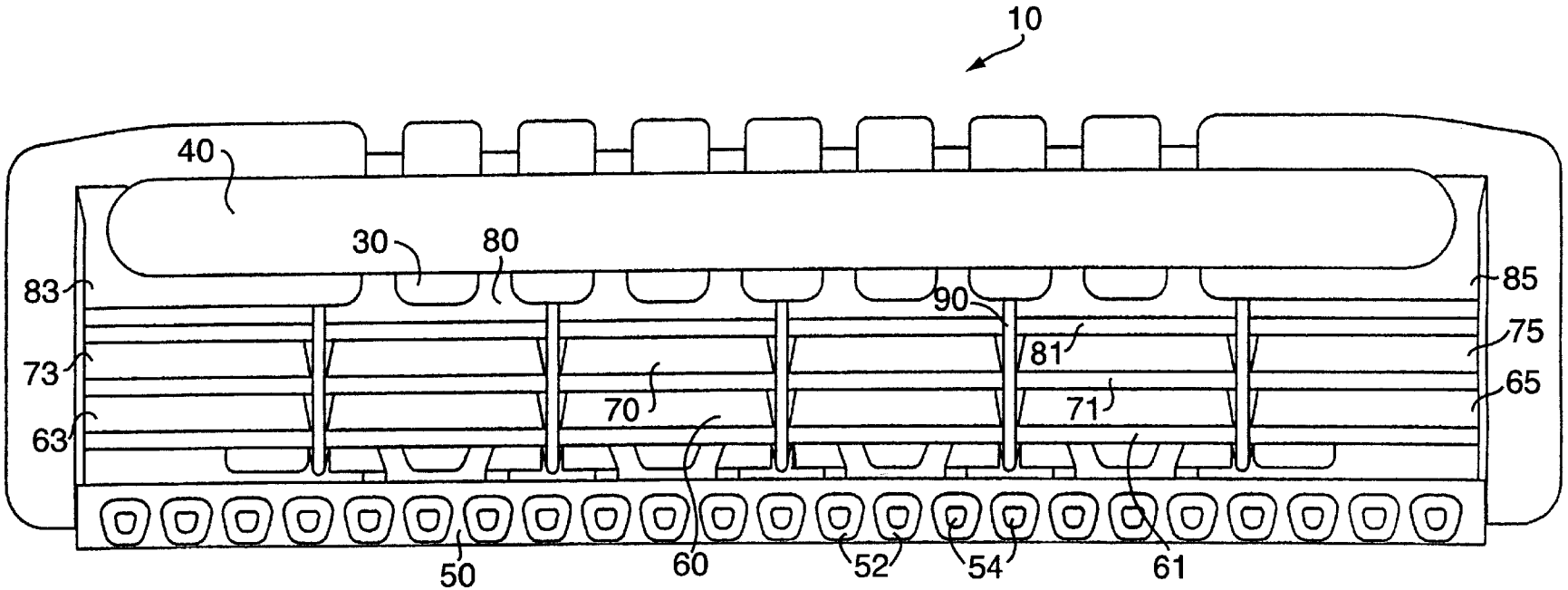
FIG. 3 is a plan view of the embodiment illustrated in FIG. 1.

One preferred embodiment of the present invention comprises a razor head 10 and is illustrated in FIG. 1. Razor head 10 comprises a blade support or base 20, cap member 30, shaving aid 40, forward guard member 50, leading blade 60, middle blade 70 and cap blade 80. Each blade 60, 70, 80 comprises a substantially flat blade, has substantially parallel planar faces, a sharp edge 61, 71, 81, a first end 63, 73, 83 and a second end 65, 75, 85, respectively. In accordance with this illustrated embodiment of the present invention, a plurality of intermediate guard elements 90 extend over the leading edges 61, 71, 81 of each blade. As best shown in FIG. 2 the intermediate guard elements 90 of this illustrated embodiment are integrally formed with blade spacers 95, base 20 and cap member 30. From the present description, those skilled in the art will appreciate that these elements, namely the base 20, guard element 90, spacers 95 and cap members 30 can be formed in a single injection molding step utilizing any suitable thermoplastic material such as polypropylene or ABS (acetalbutylstyrene).

Guard elements 90 advantageously limit the amount of skin that can flow between adjacent blades and thereby minimizes the risk of nicks and cuts during shaving. While the embodiment of the present invention illustrated in FIG. 1 comprises five intermediate guard elements 90, it is within the scope of the present invention to utilize either more or fewer guard elements as desired. As used herein with respect to the positioning of the guard elements, the terms "intermediate" and "intermediate portions" refer to the portions of the blades between first ends 63, 73, 83 and second ends 65, 75 and 85. The "intermediate" guard elements are spaced from the razor heads sidewalls 23 and 25 which commonly extend over the sides and forward corners of each blade in order to prevent those sharpened corners from nicking or cutting the person shaving.

In this illustrated embodiment, forward guard member 50 is advantageously formed with a material comprising a higher coefficient of friction, e.g., rubber or rubber type compounds, than the thermoplastic utilized to form the base 20, guard elements 90 and a cap member 30, in order to stretch the skin before it encounters the sharp edges of the blades. The forward guard element also comprises an irregular surface in order to provide better gripping of the skin surface prior to contact with the blades. In this illustrated embodiment, forward guard member 50 advantageously comprises a plurality of recesses 52 and projections 54 in order to better grip the skin surface. Forward guard element 50 is preferably also formed in a molding process, most preferably during a sequential molding step following the molding of the blade support or base 20, cap 30, and guard elements 90.

The shaving aid 40 can be formed of any desired materials, such as those known in the art, including but not limited to polyox, aloe vera, lanolin, vitamin E, etc. Shaving aid 40 is preferably molded within a recess of the cap 30 and is also preferably formed on razor head 10 in a sequential molding step before, after or simultaneously with the formation of forward guard member 50.

Figure 4:
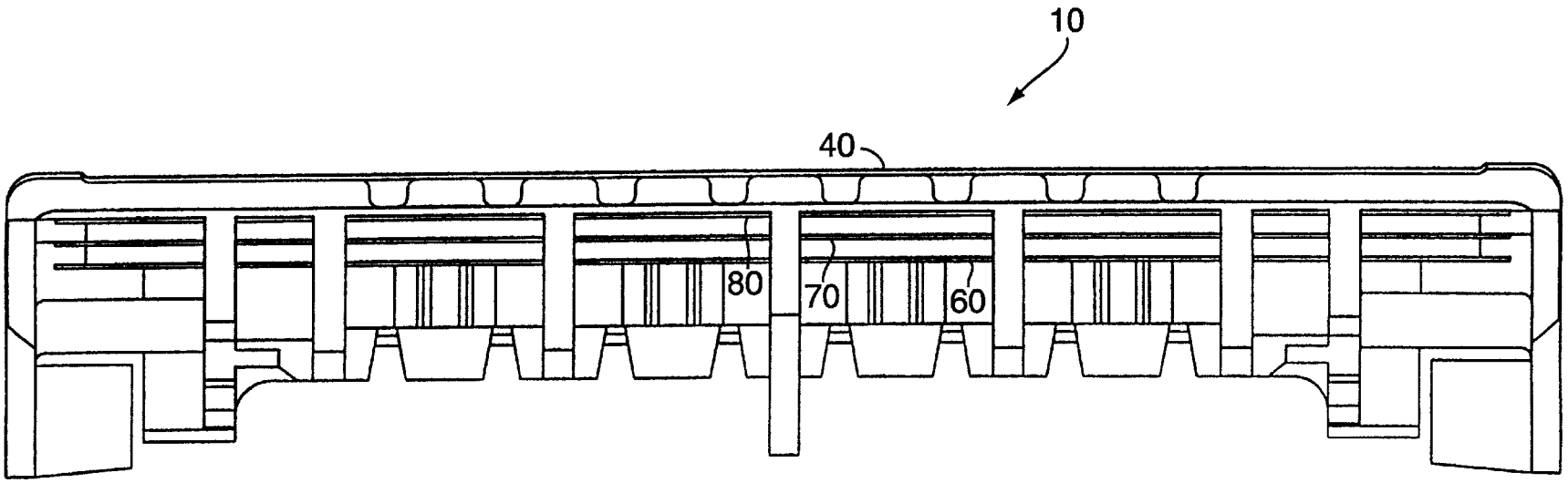
FIG. 4 is a rear view of the embodiment illustrated in FIG. 1.
Figure 5:
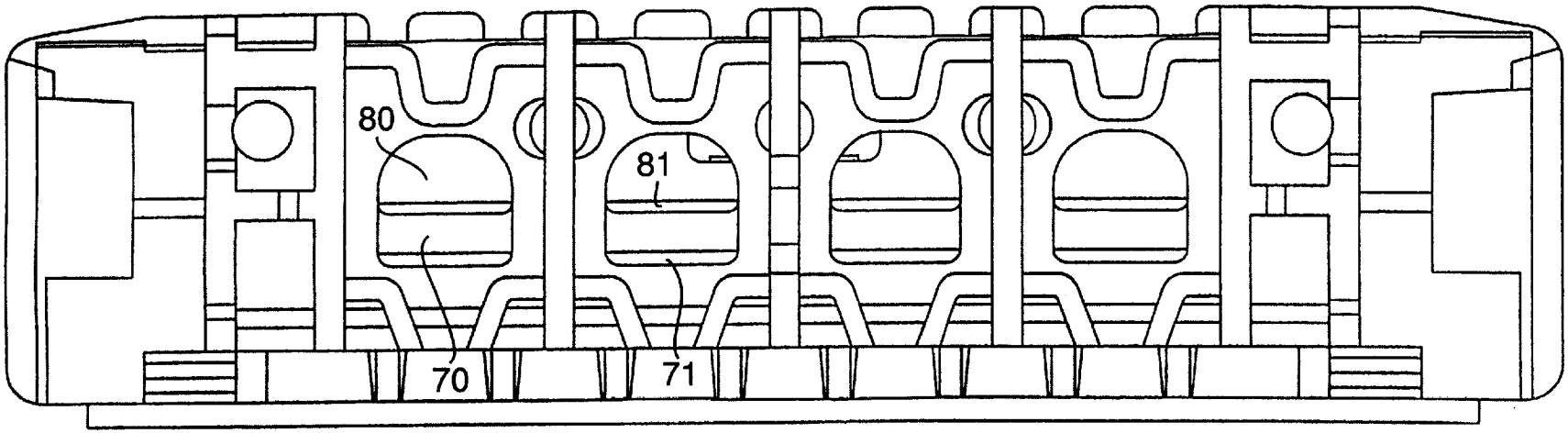
FIG. 5 is a bottom view of the embodiment illustrated in FIG. 1.

According to this preferred illustrated embodiment, each guard element 90 and spacer 95 advantageously support substantial portions of each blade in order to minimize the relative movement, e.g., deflection or "chatter", of the blades during shaving. As best shown in FIG. 2, these illustrated intermediate guard elements are formed with a wider base which tapers to a narrower skin engaging portion. The broader base provides greater blade support. As best shown in FIG. 2, the rear view of FIG. 4, and bottom view of FIG. 5, the position of spacers 95 and guard elements 90 advantageously leave substantial open spaces which enhance rinsing of shaving debris, e.g., hair, shaving cream, etc., from the razor head. The bottom view of FIG. 5 also shows flexing members and wash through slots in the blades.

The razor heads of the present invention can be rigid, flexible or can take forms other than the illustrated embodiments. The illustrated embodiment of FIGS. 1–5 is designed for attachment to a razor handle (not shown).

Figure 6:
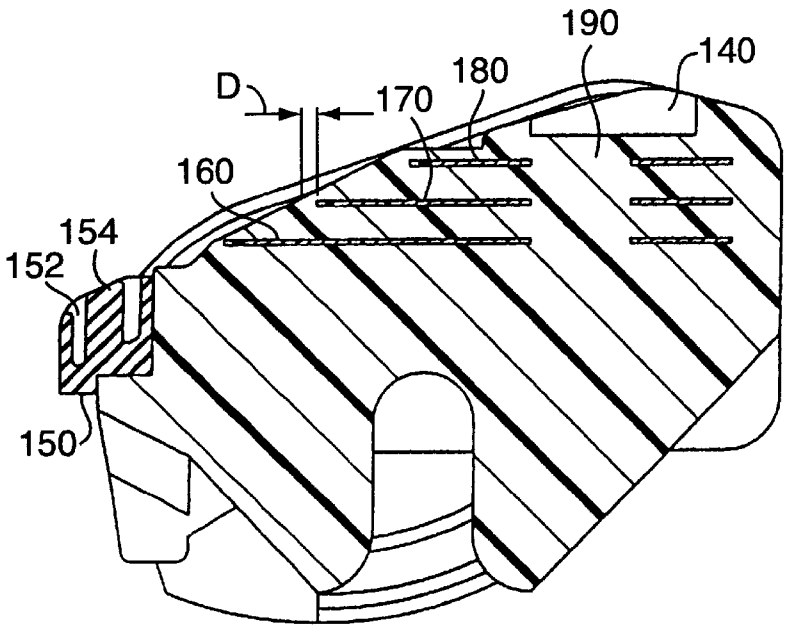
FIG. 6 is a cross sectional view of another embodiment of the present invention.

FIG. 6 is a cross sectional view of one embodiment of the present invention. This figure illustrates the distance D by which the leading skin engaging surface of guard element 90 leads or precedes the sharp edges of each blade. The distance D is defined herein as the distance between the leading edge of a flat blade and the leading or forward surface of the guard element as measured along a line disposed within a cutting plane of the blade which cutting plane contains a sharp leading edge portion of the blade. Since the guard elements of the various embodiments of the present invention are formed utilizing molds, the distance D can be designed to be any distance desired. Moreover, one advantage of the various embodiments of the present invention when compared with wire wrapped blades is that the distance D can be greater or less than the width W of the guard elements. It is also within the scope of the present invention to provide different size and different shape guard elements within a single razor head. Moreover a single guard element can have different distances D relative to one or more blades. As shown in FIG. 6, the distance D is less for seat blade 160 than the corresponding distance D of cap blade 180 along this single guard element 190.

Figure 7:
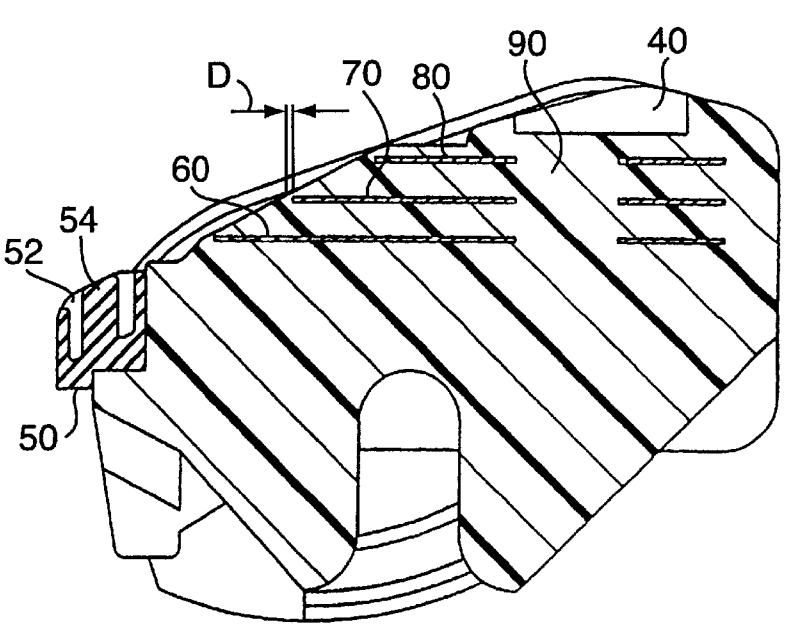
FIG. 7 is a cross sectional view of an alternative embodiment of the present invention.

FIG. 7 is a cross sectional view of an alternative embodiment of the present invention wherein the distances D for three blades are more nearly uniform or constant than those distances in the embodiment illustrated in FIG. 6. It is also within the scope of the present invention to provide a razor head comprising a plurality of intermediate guard elements wherein the distance D of a first guard element does not extend as far from the leading edges of a particular blade as does the leading edge of another guard element associated with the same blade. Thus, from the present description and drawings, it will be appreciated that the present invention provides a wide degree of design flexibility in changing the distance D and width W between different blades or at different intermediate positions along the same blade in order to optimize shave safety and comfort. The cross sectional views of FIGS. 6 and 7 also clearly illustrate how intermediate guard elements provide additional support to prevent unwanted movement of blade edges during shaving and may properly be described as guard/blade support elements.

Figure 8:
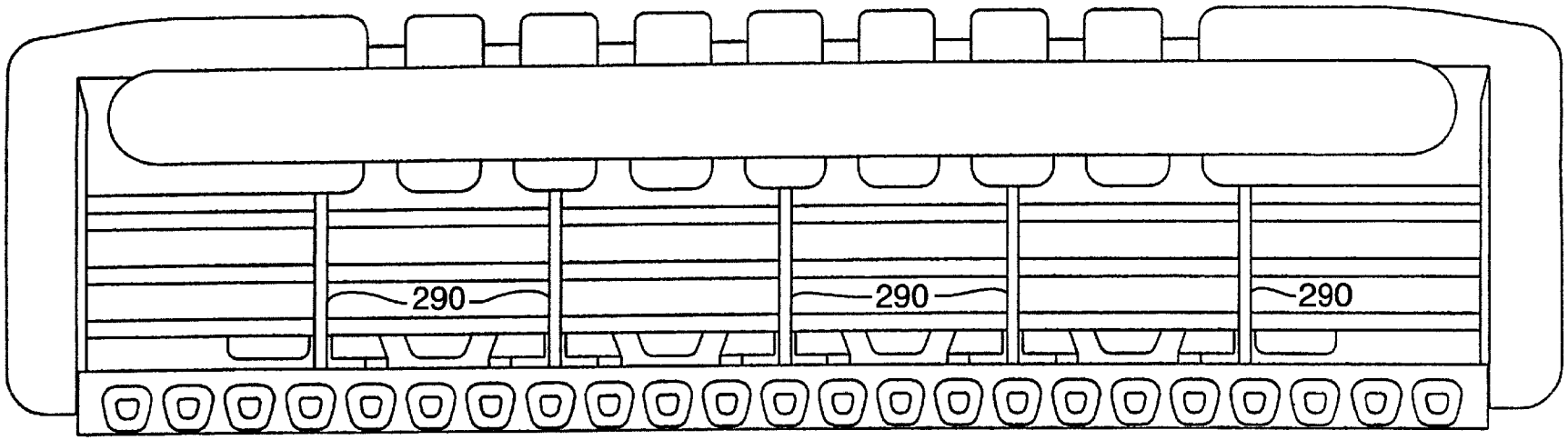
FIG. 8 is a top view of an embodiment of the present invention comprising five, relatively thin intermediate guard elements of uniform thickness.

FIG. 8 is a top view of an alternative embodiment of the present invention. As compared to the guard elements shown in FIGS. 1–3 which have pyramidal cross sections for providing extra support to the blades, the guard elements 290 of FIG. 8 have a constant width for their entire height.

Figure 9:
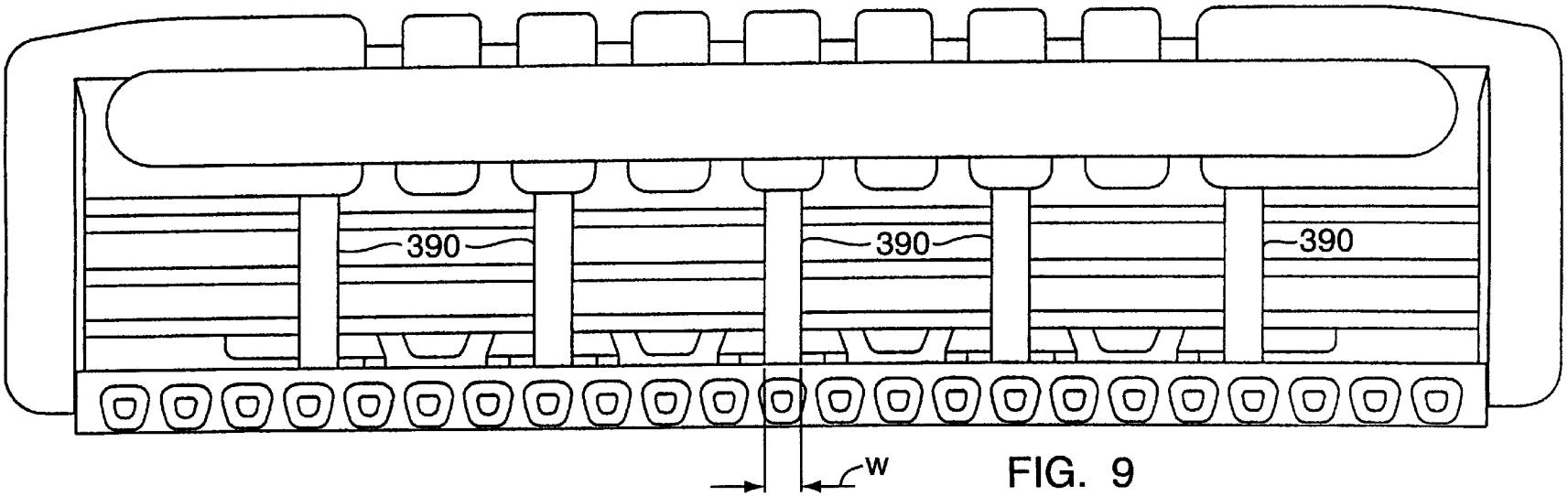
FIG. 9 is a top view of an embodiment of the present invention comprising five relatively wide intermediate guard elements.

FIG. 9 shows still another embodiment wherein the guard elements 390 are wider than the guard elements 290 shown in FIG. 8, having a width W (FIG. 9).

Figure 10:
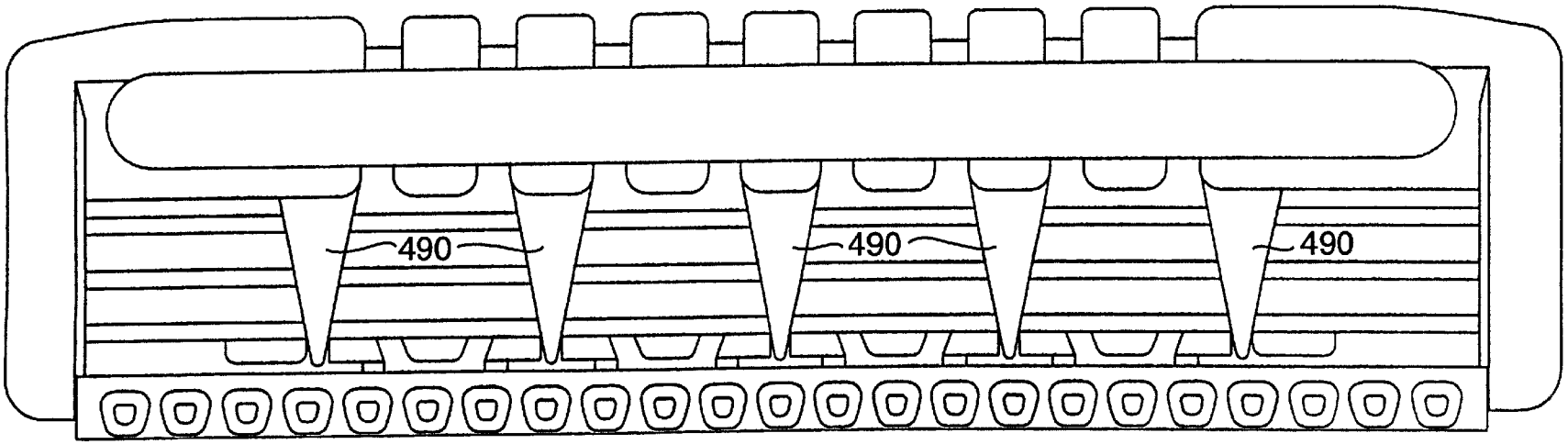
FIG. 10 is a top view of an embodiment of the present invention comprising five tapered intermediate guard elements.
Figure 11:
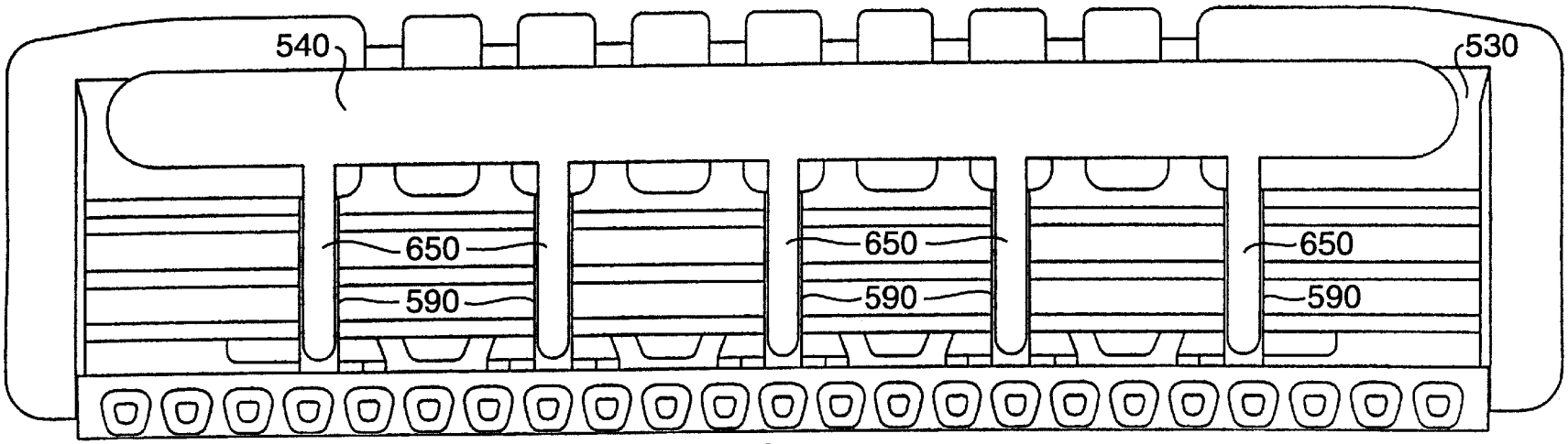
FIG. 11 is a top view of an embodiment of the present invention wherein a shaving aid extends from the cap forwardly on each of five intermediate guard elements.

It is also within the scope of the present invention to provide intermediate guard elements having different shapes. As illustrated in FIG. 10, one razor head of the present invention comprises guard elements 490 which are tapered in a manner which provides greater blade exposure for the seat blade and less exposure for the cap blade. Other configurations are also possible. As illustrated in the embodiment of FIG. 11, the intermediate guard elements 590 of the present invention also provide additional locations for skin engaging elements having different coefficients of friction than thermoplastic. In the embodiment illustrated in FIG. 11, shaving aid material 540 extends down from the cap area 530 along the length of the intermediate guard elements 590 in order to provide areas of low friction skin engaging contact. While this illustrated embodiment shows each of five intermediate skin engaging elements as supporting a "shaving aid" material, it is also within the scope of the present invention to provide a shaving aid material on only one or more of the intermediate guard elements or only on portions of one or more of an intermediate element.

Figure 12:
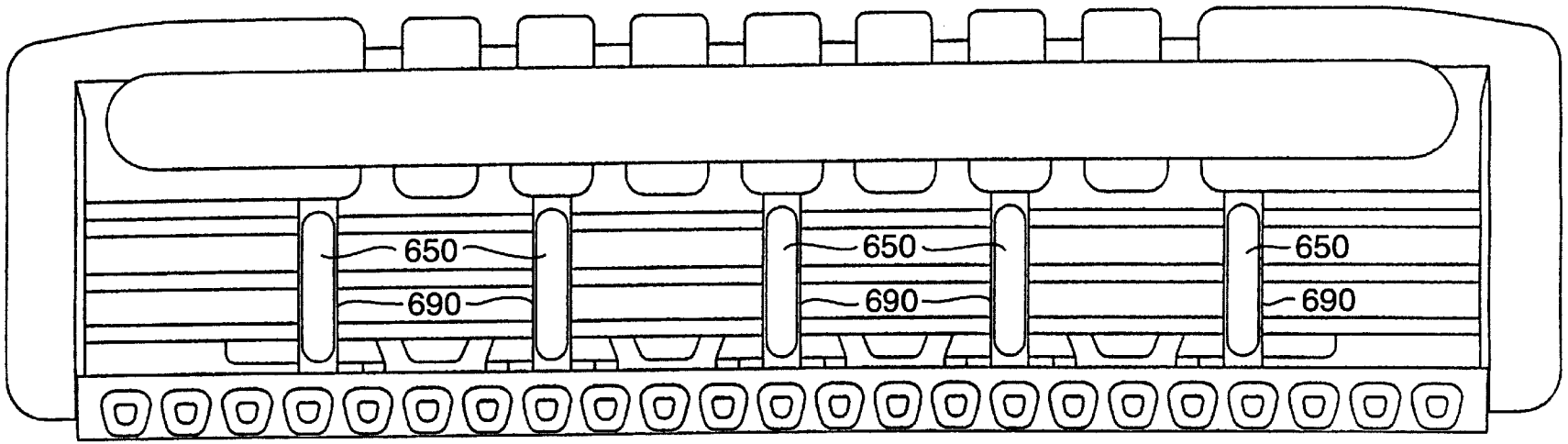
FIG. 12 is a top view of an embodiment of the present invention comprising high coefficient of friction material on each of five intermediate guard elements.

FIG. 12 illustrates a still further embodiment of the present invention wherein a high coefficient of friction material 650, for example, a rubber type compound, is positioned on the intermediate guard elements 690. As described above with respect to the shaving aid type material, the high coefficient of friction material 650 can be positioned on all of the intermediate guard elements, on only some of the guard elements or on portions of one or more guard elements. Though not illustrated, one or more of the guard elements can support both a shaving aid and a high coefficient of friction material.

Figure 13:
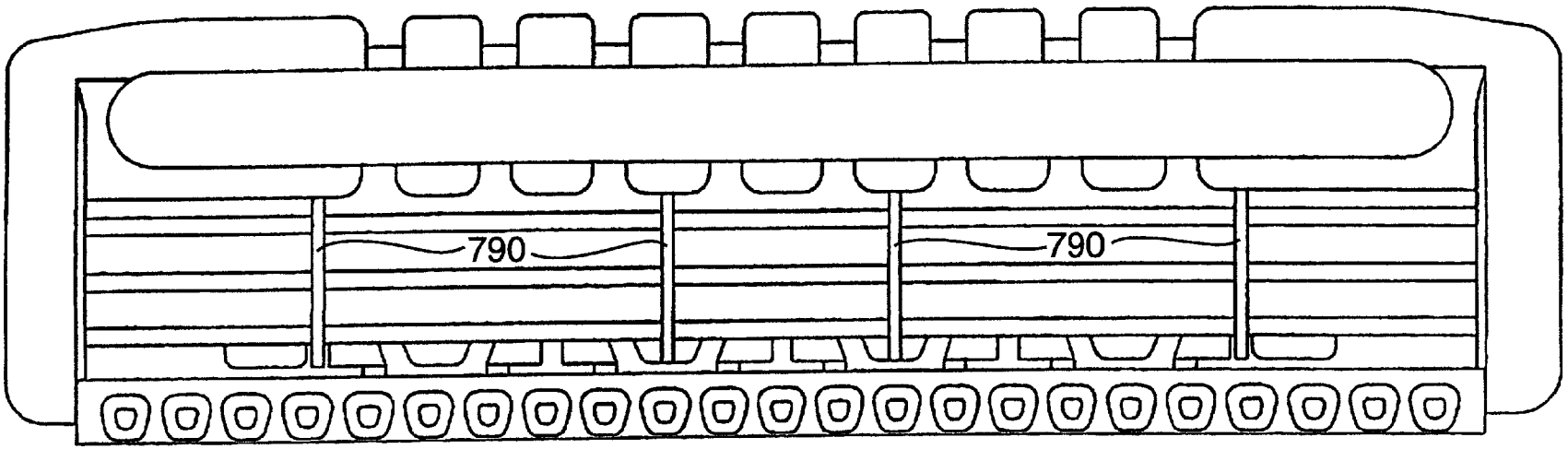
FIG. 13 is a top view of another embodiment of the present invention wherein four intermediate guard elements are unevenly spaced.

Though the previously illustrated embodiments have shown guard elements which are substantially evenly spaced along the length of the blade edges, it is also within the scope of the present invention to provide one or more intermediate guard elements which are not evenly spaced. As shown in the embodiment of the present invention illustrated in FIG. 13, intermediate guard elements 790 can be positioned at different locations along the length of the blade edges.

Figure 14:
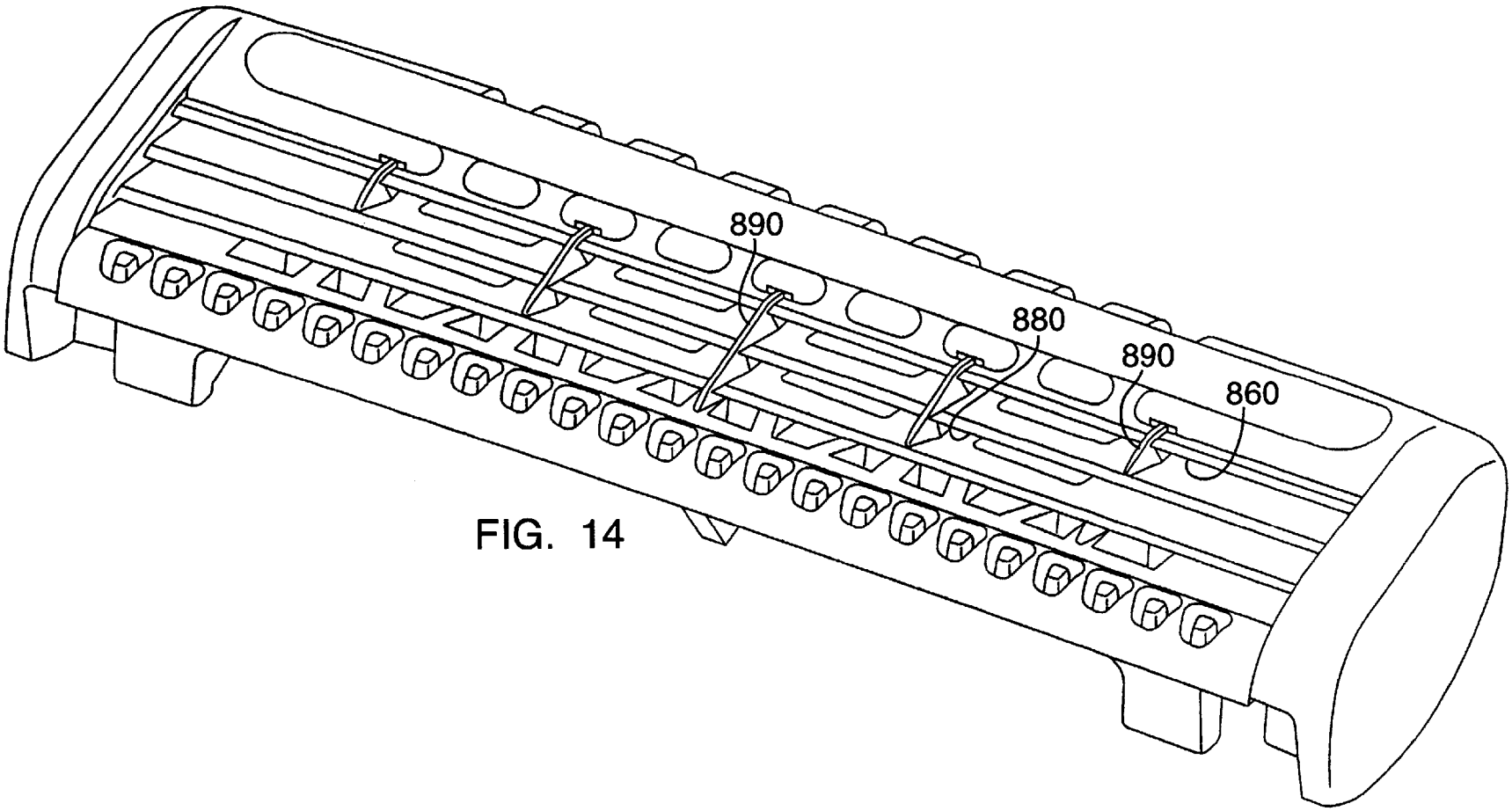
FIG. 14 is a top view of a still further embodiment of the present invention wherein intermediate guard elements cover portions of some blades but not all blades.

According to a still further embodiment of the present invention, at least one intermediate guard element 890 extends over a first blade edge 860 but not over a second blade edge 880. In this manner, the corresponding portion of the second blade edge 880 contacts the skin surface while a corresponding portion of another blade in the same razor head does not contact the skin surface. Therefore, in accordance with another aspect of the present invention, an example of which is shown in FIG. 14, an intermediate guard element may cover portions of one or more blades but not all of the blades in the razor head.

One embodiment of the present invention comprises a razor head comprising a blade support, at least one blade comprising a first end, a second end, intermediate portions and a sharp edge, and at least one and preferably a plurality of spaced intermediate molded skin engaging elements covering intermediate portions of the sharp edge. While the embodiment of the present invention illustrated in FIG. 1 comprises three blades, at least some of the advantages of the present invention can be realized in a single blade or double blade razor head. Alternatively, more than three blades can be utilized.

The materials utilized to form the molded guard elements of the present invention are most preferably thermoplastics such as polypropylene and ABS (acetalbutylstyrene) but can also comprise chemical resistant materials to maintain the integrity of the razor head.

As noted above, one advantage of the various embodiments of the present invention is that the guard elements can readily be molded and therefore the entire razor head can be molded in a single or sequential molding process. One preferred method of making a razor head according to the present invention comprises providing a plurality of blades each comprising a first end, a second end, intermediate portions and at least one sharp edge, arranging the plurality of blades in a mold cavity with the sharp edges in spaced relation, and molding a plurality of guard elements around spaced, intermediate portions of the leading edges of the blades. While the guard elements could conceivably be molded around unsharpened portions of the blade, with present technology it is preferable to provide blades with an entirely sharpened leading edge and for the intermediate guard elements to cover sharpened intermediate portions of the leading edge of the blade. Additionally, one or more of the other elements of the razor head can be formed in a single step or in a separate, e.g. sequential, step. For example, the base, cap and side walls can be formed before, during or after the molding of the guard elements. In the preferred illustrated embodiments, the base, side walls, cap, spacers and guard elements are formed in a single molding step. Then the shaving aid materials and high friction guard member are formed in one or more subsequent steps.

According to a less preferred method of making razor heads of the present invention, a plurality of elements including some or each of the cap, blades, guard member, spacers, intermediate guard elements and end caps can be formed separately and then assembled. For example, one or more intermediate guard elements can be integrally formed with spacers and the spacers are then assembled along with a base, cap and plurality of blades to form a razor head. For example, a razor head of the present invention can be assembled comprising a cap member having downwardly extending intermediate guard elements which cover portions of one or more blade edges.

What is claimed is:

1. A razor head comprising:

a blade support;

at least one blade having a first end, a second end, and a leading edge extending between said first end and said second end and comprising at least one sharp portion; and at least one thermoplastic skin engaging guard element engaging and covering a portion of said leading edge spaced from and located between said first end and said second end.

2. A razor head according to claim 1 comprising a plurality of thermoplastic skin engaging guard elements.

3. A razor head according to claim 1 comprising a plurality of blades each comprising at least one sharp edge.

4. A razor head according to claim 3 wherein said blades are spaced apart and a major portion of a space between said blades is unobstructed to facilitate rinsing of shaving debris.

5. A razor head according to claim 2 wherein at least one of said guard elements comprises a leading edge comprising a shaving aid.

6. A razor head according to claim 2 wherein at least one of said guard elements comprises a resilient material having a higher coefficient of friction than said blade support.

7. A razor head according to claim 2 wherein at least one of said guard elements comprises a leading surface spaced a first distance from a leading blade edge and another of said guard elements comprises a leading surface spaced a second distance from a leading blade edge, and wherein said first distance is different from said second distance.

8. A razor head according to claim 1 wherein said razor head is flexible.

9. A razor head according to claim 2 wherein the razor head has a plurality of substantially flat blades and at least one of said guard elements comprises a leading surface spaced a first distance from a first blade edge and a second distance from a second blade edge, as measured within cutting planes of the respective blades which cutting planes contain the sharp leading edge portions of said blades, and wherein said first distance is different from said second distance.

10. A razor head according to claim 1 wherein said at least one guard element has a tapered width which converges in the direction of said leading edge.

11. A razor head according to claim 1 wherein said at least one guard element has a leading edge and a base and wherein the leading edge is narrower than the base.

12. A razor head according to claim 1 wherein said at least one guard element has a width which is greater than the distance between a leading edge of the guard element and a forward edge of the blade as measured within a cutting plane of the blade.

13. A razor head according to claim 1 wherein said at least one guard element comprises both a high coefficient of friction material and a shaving aid material.

14. A razor head according to claim 1 comprising a plurality of evenly spaced guard elements.

15. A razor head according to claim 1 comprising a plurality of unevenly spaced guard elements.

16. A razor head according to claim 2 wherein said guard elements are spaced about 2 mm–8 mm.

17. A razor head according to claim 2 wherein said guard elements are spaced about 3 mm–7 mm.

18. A razor head according to claim 1 wherein said guard element is positioned proximate the center of said razor head.

19. A razor head according to claim 2 wherein said razor head comprises at least two blades and at least one of said guard elements comprises a leading surface spaced a first distance from a leading edge of one of said blades and a different, second distance from another of said blades.

20. A razor head according to claim 1 further comprising a spacer integrally formed with said guard element.

21. A razor head according to claim 1 further comprising a cap member.

22. A razor head according to claim 21 wherein said cap member is integrally formed with said at least one guard element.

23. A razor head according to claim 21 further comprising a shaving aid.

24. A razor head according to claim 1 further comprising a forward guard member.

25. A razor head according to claim 24 wherein said forward guard member comprises a resilient portion.

26. A razor head according to claim 1 further comprising a segmented cap member.

27. A razor head according to claim 26 further comprising a shaving aid.

28. A razor head according to claim 26 further comprising a forward guard member.

29. A razor head according to claim 28 wherein said forward guard member comprises a resilient portion.

30. A razor head according to claim 1 wherein said intermediate guard element is integrally formed with said blade support.

31. A razor head comprising:

a blade support;

a plurality of blades, each of said blades comprising a first end, a second end, discrete portions intermediate said first end and said second end and a sharp edge; and a plurality of spaced, thermoplastic guard elements separating said discrete portions from each other, each of said guard elements engaging and covering a portion of said sharp edge of at least one of said blades.

32. A razor head according to claim 31 comprising at least one spacer and wherein at least one of said guard elements is integrally formed with said spacer.

33. A razor head according to claim 31 wherein at least one of said guard elements comprises a leading edge comprising a shaving aid.

34. A razor head according to claim 31 wherein at least one of said guard elements comprises a resilient material having a higher coefficient of friction than said blade support.

35. A razor head according to claim 31 wherein at least one of said guard elements comprises a leading surface spaced a first distance from a leading blade edge and a second guard element comprises a leading surface spaced a second distance from a leading blade edge, and wherein said first distance is different from said second distance.

36. A razor head according to claim 31 wherein said razor head is flexible.

37. A razor head according to claim 31 wherein at least one of said guard elements comprises a leading surface spaced a first distance from a first blade edge and a second distance from a second blade edge, as measured along the cutting planes of the respective blades, and wherein said first distance is different from said second distance.

38. A razor head according to claim 31 wherein at least one of said guard elements has a width which is tapered in a plane substantially parallel to the cutting plane of an associated one of said blades.

39. A razor head according to claim 31 wherein at least one of said guard elements has a width which is greater than the distance between the leading edge of said at least one of said guard elements and a forward blade edge as measured along the cutting plane of the blade.

40. A razor head according to claim 39 wherein said at least one of said guard elements extends about 0.5 mm–0.4 mm from said blade edge.

41. A razor head according to claim 39 wherein said at least one of said guard elements extends about 0.1 mm–0.2 mm from said blade edge.

42. A razor head according to claim 39 wherein said at least one of said guard elements extends about 0.14 mm–0.18 mm from said blade edge.

43. A razor head comprising: a base, a cap; and at least one substantially flat blade having a forward leading edge defining exposed sharp edges of said blade, at least one thermoplastic guard/blade support element connected to and extending between said base and said cap and supporting said blade between said base and said cap in parallel spaced apart relation to said base and said cap, said guard/blade support element extending transversely of said blade and forwardly beyond said leading edge, said guard/blade support element engaging and covering an associated portion of said leading edge and separating from each other discrete portions of said blade and said exposed sharp edges, said guard/blade support element defining a skin engaging leading surface forward of said sharp edges.

44. A razor head as set forth in claim 43 including a plurality of parallel spaced apart substantially flat blades.

45. A razor head as set forth in claim 43 including a plurality of spaced apart guard/blade support elements.

46. A razor head as set forth in claim 43 wherein said at least one guard/blade support element is integrally connected to said base and said cap.

* * * * *